US009789349B2

(12) United States Patent
Rahnasto et al.

(10) Patent No.: US 9,789,349 B2
(45) Date of Patent: Oct. 17, 2017

(54) TRAINING DEVICE

(71) Applicant: OLKICONTROL OY, Vantaa (FI)

(72) Inventors: Olli Rahnasto, Vantaa (FI); Kirsi Rahnasto, Vantaa (FI)

(73) Assignee: Olkicontrol OV, Vantaa (FI)

( * ) Notice: Subject to any disclaimer, the term of this patent is extended or adjusted under 35 U.S.C. 154(b) by 0 days.

(21) Appl. No.: 14/903,881

(22) PCT Filed: Jul. 10, 2013

(86) PCT No.: PCT/FI2013/050742
§ 371 (c)(1),
(2) Date: Jan. 8, 2016

(87) PCT Pub. No.: WO2015/004308
PCT Pub. Date: Jan. 15, 2015

(65) Prior Publication Data
US 2016/0228737 A1 Aug. 11, 2016

(51) Int. Cl.
*A63B 21/06* (2006.01)
*A63B 23/02* (2006.01)
(Continued)

(52) U.S. Cl.
CPC ..... *A63B 21/0618* (2013.01); *A63B 21/0004* (2013.01); *A63B 21/00065* (2013.01); *A63B 21/062* (2013.01); *A63B 21/0628* (2015.10); *A63B 21/4035* (2015.10); *A63B 22/20* (2013.01); *A63B 23/0205* (2013.01);
(Continued)

(58) Field of Classification Search
CPC ..... A63B 21/0618; A63B 21/062; A63B 21/0004; A63B 21/00065; A63B 21/4035; A63B 21/0628; A63B 21/227; A63B 21/225; A63B 21/00072; A63B 23/0205; A63B 23/0211; A63B 23/03525; A63B 23/1209; A63B 22/20; A63B 22/203; A63B 22/14; A63B 2023/003; A63B 2022/206; A63B 2208/0204
See application file for complete search history.

(56) References Cited

U.S. PATENT DOCUMENTS 4,134,584 A 1/1979 Rosenbusch
4,477,074 A 10/1984 Bushnell
(Continued)

FOREIGN PATENT DOCUMENTS

CN 201894806 U 7/2011

OTHER PUBLICATIONS

International Search Report of the International Searching Authority for Application No. PCT/FI2013/050742, dated Mar. 10, 2014.
(Continued)

*Primary Examiner* — Andrew S Lo
*Assistant Examiner* — Megan Anderson
(74) *Attorney, Agent, or Firm* — Alston & Bird LLP

(57) ABSTRACT

A training device (1) for training abdominal muscles comprising an arm (3) and a handle (2) for holding with two hands, the handle (2) being attached to or forming an integral part of the arm (3). There are disclosed different embodiments allowing a user to hold the handle (2) and to make arch-like training movements in order to train control of abdominal muscle activity.

26 Claims, 4 Drawing Sheets

(51) Int. Cl.

| | |
|---|---|
| ***A63B 23/035*** | (2006.01) |
| ***A63B 23/12*** | (2006.01) |
| ***A63B 21/062*** | (2006.01) |
| *A63B 22/14* | (2006.01) |
| *A63B 21/22* | (2006.01) |
| *A63B 22/20* | (2006.01) |
| *A63B 23/00* | (2006.01) |
| *A63B 21/00* | (2006.01) |
| *A63B 71/00* | (2006.01) |
| *A63B 71/02* | (2006.01) |

(52) U.S. Cl.

CPC .... *A63B 23/0211* (2013.01); *A63B 23/03525* (2013.01); *A63B 23/1209* (2013.01); *A63B 21/00072* (2013.01); *A63B 21/225* (2013.01); *A63B 21/227* (2013.01); *A63B 22/14* (2013.01); *A63B 22/203* (2013.01); *A63B 71/0036* (2013.01); *A63B 2022/206* (2013.01); *A63B 2023/003* (2013.01); *A63B 2071/025* (2013.01); *A63B 2208/0204* (2013.01); *A63B 2225/093* (2013.01)

(56) References Cited

U.S. PATENT DOCUMENTS

| | | | | |
|---|---|---|---|---|
| 4,515,363 | A | 5/1985 | Schleffendorf | |
| 5,810,697 | A * | 9/1998 | Joiner | A63B 21/06 280/47.371 |
| 5,941,807 | A | 8/1999 | Cassidy et al. | |
| 6,511,083 | B1 * | 1/2003 | Tsai | A63C 17/01 280/87.021 |
| 6,942,585 | B1 | 9/2005 | Krause | |
| 7,226,062 | B1 * | 6/2007 | Stefano | A63C 17/01 280/263 |
| 7,794,375 | B1 * | 9/2010 | Jackson, Jr. | A63B 23/0494 135/67 |
| 7,803,098 | B2 * | 9/2010 | Cofrin | A63B 21/0618 16/437 |
| 8,858,405 | B2 * | 10/2014 | Agate | A63B 21/0618 482/106 |
| 8,905,901 | B2 * | 12/2014 | Stewart | A63B 21/0004 473/441 |
| D770,571 | S * | 11/2016 | Rahnasto | D21/423 |
| 2003/0050153 | A1 | 3/2003 | Stevens | |
| 2003/0125172 | A1 | 7/2003 | Slowinski | |
| 2007/0270294 | A1 | 11/2007 | Sheets | |
| 2009/0239720 | A1 | 9/2009 | Osbak | |
| 2013/0023391 | A1 | 1/2013 | Nicholas | |
| 2013/0172159 | A1 | 7/2013 | Stewart et al. | |

OTHER PUBLICATIONS

International Preliminary Report on Patentability for Application No. PCT/FI2013/050742, dated Oct. 23, 2015.

Supplementary European Search Report for Application No. EP 13 88 8945 dated Jan. 3, 2017.

* cited by examiner 1
2
3
4
5
6
7
8
x
y

TRAINING DEVICE

FIELD OF THE INVENTION

The present invention relates to a training device for improving abdominal muscle control.

BACKGROUND OF THE INVENTION

Abdominal muscles, together with the back muscles, provide support for the trunk of a human body and enable its movement in different directions. These muscles are layered, and especially the muscles closer to the spine, the so-called inner abdominal muscles (the transverse abdominal muscle and the internal oblique muscles), affect the posture and stability of the trunk as well as the appropriate placement of internal organs.

Well-trained inner abdominal muscles are known for promoting trunk control and thus back health. However, they are also important in almost any type of physical activity, ranging from ballet dancing to racket sports, such as tennis. In addition to their strength, also the ability to control and be aware of the muscles is essential for sports performance. Focused force production during specified stages of movement determines how the power produced by the body is conveyed to the actual object to be moved by that power. Inner abdominal muscle control also adds to the balance of the movement, thus helping the athlete to rapidly proceed to the next movement. Further, improved inner abdominal muscle control can help rehabilitate patients and elderly whose muscle strength has declined for some reason. Improved trunk control can prevent them from falling or developing body misalignments that could lead to further injuries or functional disorders.

In the patent document WO 2013038129, an exercise device is disclosed comprising an elongated handle and, at the distal end of the handle, at least one roller. The roller is configured to be in contact with the surface along which the exercise device is arranged to move. The axis of the portion of the handle supporting the roller is offset to the axis of the part of the handle which is held by the user.

There are also other types of training devices targeted to exercise abdominal muscles. However, typical for all the solutions is that they focus on the heaviness of the exercise motion due to some sort of a resistance to the movement. Since the muscles are required to work throughout the exercise motion, these solutions do not train the user to focus on the timing and control of the inner abdominal muscle activity, but center on the increase of muscle strength.

SUMMARY

An object of the present invention is to provide a new type of a training device for inner abdominal muscles that focuses on the timing, awareness and control of the inner abdominal muscle activity.

By a mass with an inertia suitable for physical training is herein meant a mass that resists the change of the direction of movement sufficiently to trigger a response in human muscles that is perceptible to the individual inducing the said change of the said mass. Such a mass usually varies in the range from a few kilograms to tens of kilograms depending on the physical characteristics and training goals of the user as well as on the mechanical configuration of the mass in a training device.

By a user herein is meant an individual using the training device according to the present disclosure.

By an appropriate training position herein is meant a balanced stance in which hips and shoulders are vertically aligned, head is straight and eyes look forward. Elbows are bent to an angle that is larger than 90 degrees (i.e. the angle between brachium and forearm is larger than 90 degrees), but the elbow should remain bent. Ideally the angle of the elbow is approximately 100 degrees. The hands of the user grip the training device and the wrists are substantially straight. The upper arm is vertically aligned with the trunk of the body or the elbows are slightly in front of the body.

Although for most users and training needs a standing position is suitable, the embodiments according to the present disclosure can also be modified to accommodate training in a sitting position. This would enable also users suffering from weakness, injuries or dysfunction of lower limbs to exercise with the training device according to the present disclosure. Such modification can be accomplished by, for example, providing a seat with height adjustment means, or means to fasten a wheelchair, in the training device.

By an exercise movement herein is meant a body movement, starting at the appropriate training position, in which the arms are rotated to one side and the head, the eyes and shoulders remain stationary. Also the body from hip downwards remains stationary. The exercise movement is continued for about 60 degrees to the side from a point that is in front of the user. The direction of movement is then changed through tensioning the abdominal muscles. At this point the focus of the user should be in the inner abdominal muscles. The exercise movement to the other direction is continued to the corresponding point on the other side of the user and the direction of the movement is changed again. The sideways movement is repeated several times, the number of times depending on the characteristics of the user. The user should at all times remain in control of the movement and aim at a steady movement instead of swinging or throwing motions. Unnecessary tensioning of the arms and hands should be avoided and the exercise movement should be performed with as little input as possible from other muscle groups than the inner abdominal muscles.

By wheels or gliding or rolling means herein is meant any structure which allows a low-resistance weight movement to be achieved through an exercise movement so, that the force required to change the direction of the mass to be moved is larger and clearly differentiable by the user from the force required to continue the exercise movement to the original direction. The restriction of the exercise movement sector and the change in the direction of the exercise movement are controlled by the user.

The training device for training abdominal muscles presented here is characterized by comprising an arm, a handle for holding with two hands, the handle being attached to or forming an integral part of the arm, further characterized in that the training device comprises a platform attached to or forming and integral part of the arm and configured to carry a mass, and wheels or gliding or rolling means attached to the platform for enabling movement of the training device on a surface by the user when the user is holding the handle.

In a second aspect there is disclosed a training device for training abdominal muscles comprising an arm, a handle for holding with two hands, the handle being attached to or forming an integral part of the arm, characterized in that the training device comprises a stationary training pedestal for the user to stand on, and the arm being moveably attached to the training pedestal for enabling an arch-like movement of the handle in relation to the training pedestal when the user is holding and moving the handle.

In a third aspect there is disclosed a training device for training abdominal muscles comprising an arm, a handle for holding with two hands, the handle being attached to or forming an integral part of the arm, characterized in that the training device comprises a base part to which the handle is connected, and a rotatable training pedestal for a user to stand on, the training pedestal being connected to the base part for rotation in relation to the base part.

In a fourth aspect there is disclosed a training device for training abdominal muscles comprising an arm, a handle for holding with two hands, the handle being attached to or forming an integral part of the arm, characterized in that the training device comprises an arch-shaped track or rails to which the arm is moveably attached to allow an arch-like movement of the of the handle along the track or rails, and a mass attached to the arm.

The training device according to the present disclosure offers at least one of the following advantages over prior art:

- The training device according to the present disclosure trains the user to become conscious of his/her inner abdominal muscles thus enhancing their training efficiency with other methods and the support for the body.
- The training device according to the present disclosure improves the inner abdominal muscle control of the user in addition to strengthening these muscles.
- The training device according to the present disclosure enhances athletic performance as the confidence on the stability of the trunk is improved.
- The training device according to the present disclosure is suitable for rehabilitative as well as athletic training.

In one embodiment of the first aspect of the current disclosure, the mass is either an integral part of the platform or it can be adjusted through detachable weights.

In one embodiment of the first aspect of the current disclosure, the arm is a straight piece and at an angle so that the height of the training device and the radius of the weight movement are adjusted simultaneously.

In one embodiment of the first aspect of the current disclosure, the training device is configured to be moveable to any direction.

In one embodiment of the first aspect of the current disclosure, the training device is configured to be used on a flat surface.

In one embodiment of the first aspect of the current disclosure, there are at least three wheels supporting the platform.

In one embodiment of the second aspect of the current disclosure, the training device comprises a platform configured to carry a mass and attached to the arm.

In one embodiment of the second aspect of the current disclosure, the training device comprises a platform configured to carry a mass and to be a flywheel rotated by a gearwheel through a cogged belt, and the gearwheel is configured to be turned by the handle.

In one embodiment of the second aspect of the current disclosure, the training device comprises a pair of weights configured to be reciprocally moveable by the handle connected to the weights through a wire, rope or a belt.

In one embodiment of the third aspect of the current disclosure, the training device comprises weights mounted on the training pedestal.

In one embodiment of the third aspect of the current disclosure, the training device comprises a platform configured to carry a mass and to be a flywheel rotated by the rotation of training pedestal through a cogged belt.

In one embodiment of the third aspect of the current disclosure, the training device comprises a pair of weights configured to be reciprocally moveable by the rotation of the training pedestal connected to the weights through a wire, rope or a belt.

In one embodiment of the fourth aspect of the current disclosure, the mass is carried by a platform attached to the arm.

In one embodiment of the fourth aspect of the current disclosure, the training device comprises a pair of weights configured to be reciprocally moveable by the handle connected to the weights through a wire, rope or a belt.

In a further embodiment, the training device is configured to allow variation in the radius of the arch-like movement according to user anatomy.

In yet another embodiment, the arm comprises height adjustment means.

In yet another embodiment, the arm has a joint for additional adjustment of the arm and the handle.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figures 1A, 1B:
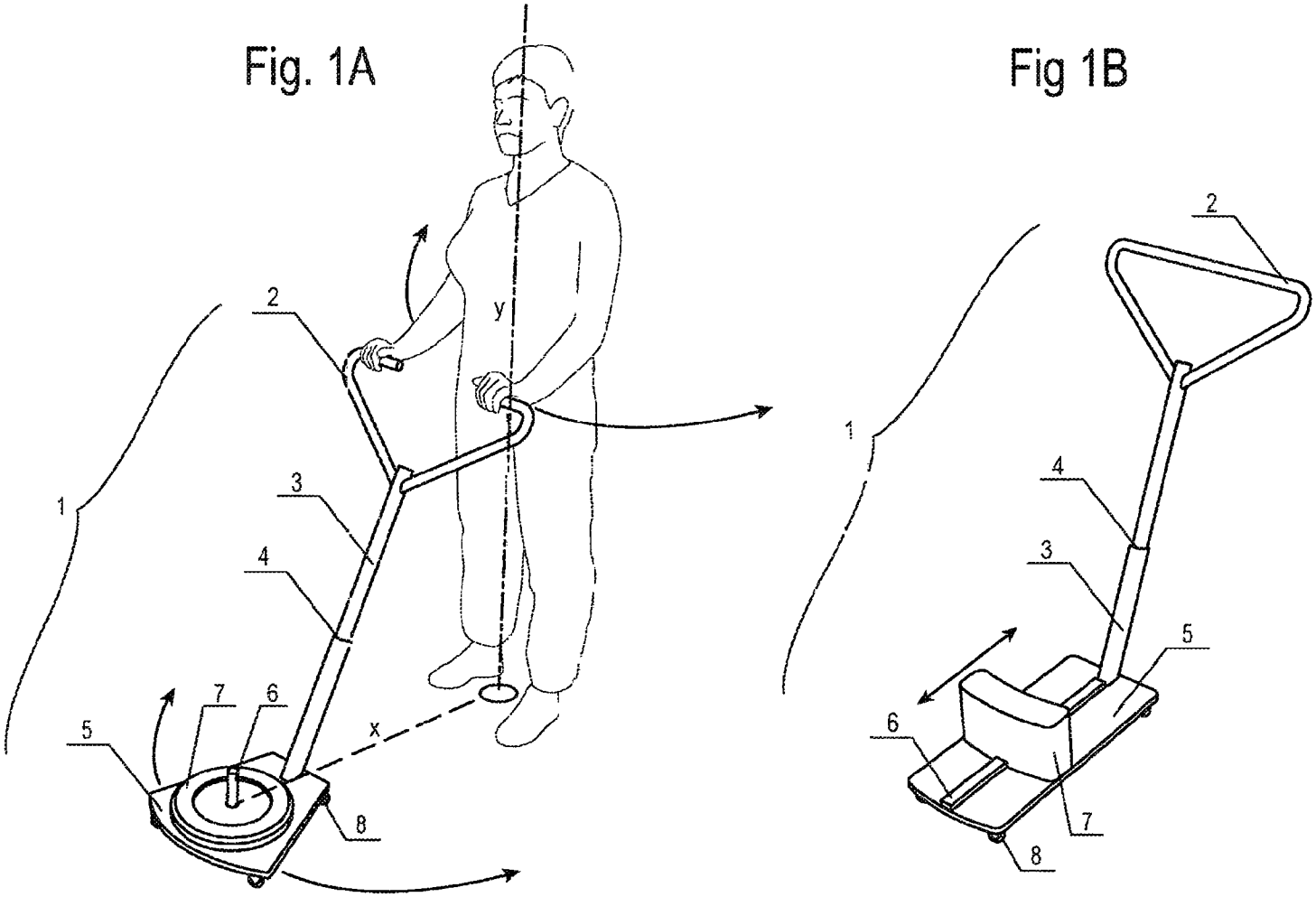
FIG. 1A presents a schematic overview of one embodiment in which the training device has wheels.
FIG. 1B presents a schematic overview of the embodiment of FIG. 1A in which the weight attachment means is configured to hold the mass to be moved at a variable distance from the user.

FIG. 1A presents a training device 1 for training abdominal muscles and a user holding the training device 1. The vertical dashed line y indicates the vertical centerline of the user's trunk, the arrows the alternating directions of the exercise movement and the horizontal dashed line x the approximate radius of the weight movement.

The training device 1 comprises a handle 2 to be held with both hands. In the embodiment of FIG. 1A, the handle 2 is shaped as a downward projecting triangle and is held from its base, but other forms are also possible. The part of the handle 2 to be held can be continuous or discontinuous.

The part of the handle 2 to be held can be horizontal, vertical or angled in between these two extremes, or the angle can be adjustable with a joint. The width of the part of the handle 2 to be held can vary to accommodate users of different body structures. In an optimal situation, the user grips the handle 2 at a width that is approximately the width of the user's shoulders. The width of the handle 2 can thus vary from approximately 35 cm to 95 cm and is, for an average-sized user, approximately 65 cm.

The training device 1 of FIG. 1A further comprises an arm 3 whose length, and thus the height of the handle 2, can be adjusted for users of different height. In the embodiment of FIG. 1A, the arm 3 is formed of two tubes, the first tube having a smaller diameter than the second tube, so that the first tube fits inside the second tube. The tubes can be secured to a desired height through height adjustment means 4, which can have any structure known in the art. They can, for example, comprise a screwable pin going through a hole in the second tube having the larger diameter and, when tightened, pressing against the first tube having the smaller diameter. Other structures for the arm 3 and height adjustment means 4 are also possible, as is apparent for a person skilled in the art. Height adjustment can be in some embodiments accomplished also through means arranged in the handle 2 of the training device 1.

The training device 1 of FIG. 1A further comprises a platform 5 that is configured to move a mass with an inertia suitable for physical training. The mass can be generated by the platform 5 itself, through additional weights 7, or their combination. The heaviness of the exercise movement is determined by the combination of the weight of the platform 5 (and of possible weights 7 thereon) and the radius of the movement of the mass. The latter depends on the length of the arm 3 of the training device 1, its angle relative to the surface on which the platform 5 is moved and on the anatomy of the user. The platform 5 can have any shape that is appropriate for its function. In the embodiment of FIG. 1A, the platform 5 is broad in comparison to its thickness, but its shape depends on the specifics of the weight attachment means 6 and the configuration of the weights 7, for example.

The angle of the arm 3 relative to the platform 5 and to the surface on which the training device 1 is moved can be for example 60 degrees, as in the embodiment of FIG. 1A, but it can vary between approximately 45 and 75 degrees. The arm 3 can also be attacked to the platform 5 through a joint to allow the adjustment of the angle of the arm 3. The change in the angle of the arm 3 affects how changing the height of the training device 1 relates to the change in the radius of the platform 5 movement during exercise. This in turn affects how much the inertia of the mass to be moved changes with a given speed of the exercise movement when the height of the training device 1 is changed. Therefore, having a jointed arm 3 might reduce the number of weights 7 needed for adjusting the mass to be moved for different users. In the embodiment of FIG. 1A, the appropriate height of the training device 1 for an average-sized user is achieved with an arm 3 length of 105 cm, but the length can vary between approximately 95 cm and 140 cm for users of different height.

In the embodiment of FIG. 1A, the training device 1 has weight attachment means 6 in the shape of a rod through which weight plates 7 can be fitted. Although not depicted in the figure, the weight attachment means 6 can comprise safety mechanisms, such as locks, to prevent the accidental release of the weights 7 from the weight attachment means 6.

In FIG. 1A, the training device 1 has four swivel wheels 8 that allow the training device 1 to move substantially freely in all directions. In this embodiment, the swivel wheels 8 have a diameter of 5 cm, but also smaller or larger wheels 8 are possible. As an alternative to swivel wheels 8, the training device 1 can be mounted on any other suitable gliding or rolling means 8, for example hard hemispheres or spherical wheels. The selection of wheels or gliding or rolling means 8 depends on the surface on which the training device 1 is used. For example on ice, the platform 5 could resemble a stone used in curling or it could be mounted on hard supports 8 functioning similarly. The wheels or gliding or rolling means 8 can also be exchangeable through a locking mechanisms that are known in the art. The number of wheels or gliding or rolling means 8 can vary, but the preferred minimum number is three, since the training device 1 should retain its upright position without force input from the user during exercise movement. There is no theoretical maximum for the number of wheels or gliding or lolling means 8.

The training device 1 according to the embodiment of FIG. 1A can have additional safety and usage aids not depicted in the figure. For example, there can be a support at the end of the platform 5 closest to the arm 3 preventing the training device 1 from falling over in situations where the weight of the platform 5 is small and the arm 3 is extended so far that the center of gravity of the training device 1 is outside the area defined by the wheels or gliding or rolling means 8. Further, the training device 1 can be accompanied with an underlay providing a suitable surface for using the training device 1 and having indications or instructions for the appropriate use of the training device 1.

The material for the training device 1 can be selected from many different alternatives known in the art for building training devices. Steel, for example, would have the benefit of being heavy enough in itself for some users. Lighter materials, such as aluminum, composite materials or wood, would allow a wider range of exercise weights in the lower end of the weight range. Some parts could be manufactured from inexpensive plastic materials as well.

The numbering adopted in FIG. 1A will be followed in the figures described below. Only the relevant features of each embodiment are described and repeated reference to all features of the training device 1 is avoided for brevity.

FIG. 1B presents the training device 1 of FIG. 1A in which the portion of the handle 2 to be held is continuous. The weight attachment means 6 allow moving the weights 7 along the direction of the radius of the exercise movement (double-headed arrow). This makes it possible to adjust the heaviness of the exercise movement without the addition or removal of weight plates, simply by changing the radius of the weight movement. The closer the weights 7 are to the user, the smaller the inertia of the training device 1 is with a given speed of body movement and vice versa. The weights 7 are a weight block 7 that can be specially designed to fit to the weight attachment means 6.

Figure 2B:
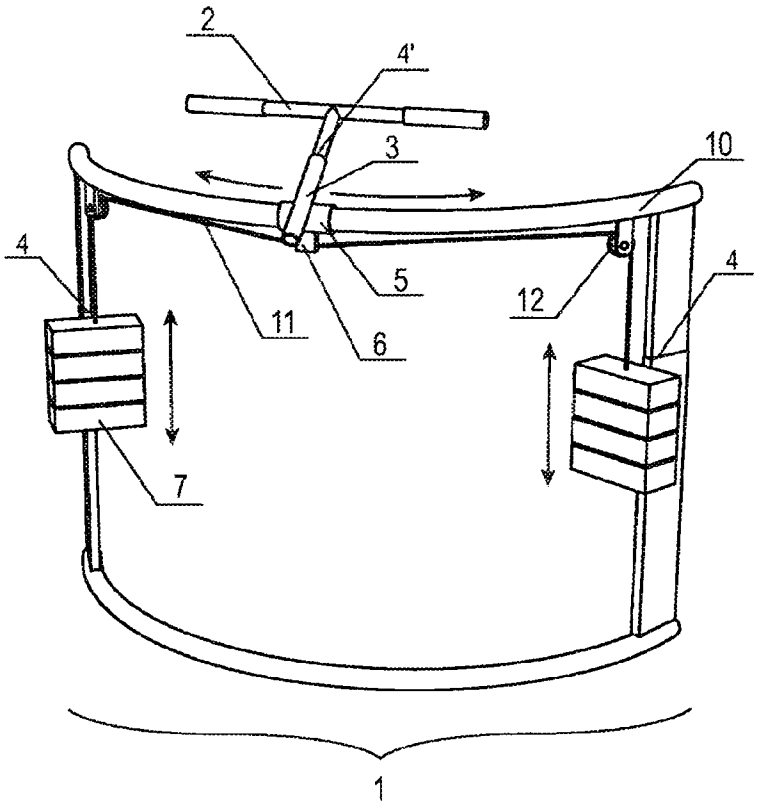
FIG. 2B presents a variation of the embodiment of FIG. 2A.
Figure 2A:
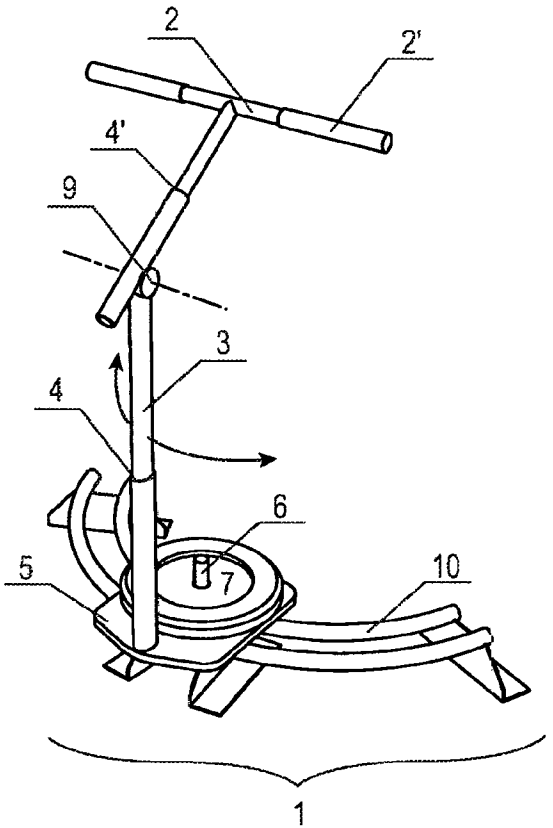
FIG. 2A presents a schematic overview of another embodiment in which the training device has a track or rails.

FIG. 2A presents an embodiment of the training device 1 in which the arm 3 is divided into two parts through a joint 9 and the platform 5 is mounted on rails 10 whose shape approximates the circular arch of the training movement (depicted by the two arrows of opposite directions). The handle 2 is a straight bar and depicted as having a grip 2' for each hand for holding. The grip 2' can have an anatomical shape and its width can be adjustable for each user. The joint 9 can have a fixed angle or the angle can be adjustable to accommodate users of differing body structure. The height adjustment means 4 is in the lower portion of the arm 3 and the upper portion has additional height adjustment means 4' that can be either securable to a specified height, free-moving or have a resistance to movement.

The rails 10 can have any construction with low enough frictional resistance to movement and their connection to the platform 5 can have bearings, many types of which are known in the art. In FIG. 2A, there are two rails 10, but for example a single track 10 could alternatively be used, and the rail or track profile can have a cross-sectional profile other than a circle.

Human body movement rarely follows exact geometrical patterns. Therefore, the training device 1 as presented in this embodiment, can have different means to accommodate the deviations of the exercise movement of the user from Ube exact circular arch defined by the rails 10. These means can be incorporated for example in the bearing of the rails 10, in the upper part of the arm 3 above the joint 9 or in the handle 2. The user can thus follow the natural movement of his/her body without being constrained by the training device 1 to an artificially geometrical movement path.

Safety features, such as stoppers for the platform 5 are omitted from FIG. 2A but can be present in practical applications.

FIG. 2B presents another embodiment of the training device 1. In this embodiment, there are two sets of weights 7 that are attached to the weight attachment means 6 through wires 11 (direction of movement depicted by the double-headed arrows). The platform 5 connecting the arm 3 and the weight attachment means 6 is small in comparison to the previous figures and is configured to move along an arched track 10 as the arm 3 attached to the handle 2 is moved by the user (depicted by the two arrows of opposite directions). Different solutions known in the art to minimize the friction between the platform 5 and the track 10 can be employed. Flexibility in the natural exercise movement of the user is accommodated through additional height adjustment means 4' that can be constructed as in FIG. 2A. The rotational exercise movement of the user is converted into a vertical movement of the weights 7 through rollers 12. There are two sets of weights 7 in the training device 1 according to this embodiment. To minimize the force needed for the movement, the weights 7 move into complementary directions, and when they are adjusted, both sets of weights 7 should have an equal mass.

Figure 3A:
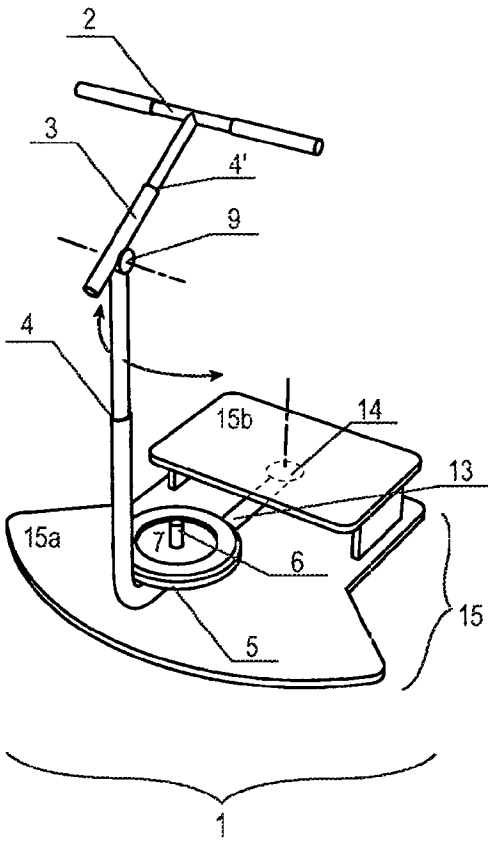
FIG. 3A presents a schematic overview of another embodiment in which the arm is rotatably hinged to a stand.

FIG. 3A presents an embodiment of the training device 1 which resembles the embodiment of FIG. 2A, but instead of rails 10, the platform 5 is fixed on a horizontal extension 13 of the arm 3 that is rotatably hinged to a stand 15 through a hinge 14 (movement depicted by the two arrows of opposite direction). The means to accommodate the natural exercise movement of the user are in the additional height adjustment means 4'. Alternatively these means can also be built into the extension 13 of the arm 3. The hinge 14 attaching the extension 13 of the arm 3 to the stand 15 is located so, that it can be aligned with the vertical centerline of the user (vertical dashed line) when the user is on the stand 15 holding the handle 2 in an appropriate training position.

The stand 15 in FIG. 3A comprises a support plate 15*a* and a training pedestal 15*b*. The hinge 14 can be attached to either or both of them. The support plate 15*a* is configured to ascertain the stability of the training device 1 and the training pedestal 15*b* allows the vertical centerline of the user to be located above the hinge 14. There can optionally be further height adjustment means in the training pedestal 15*b*.

In FIG. 3A the platform 5 carrying the weights 7 is on the same side of the hinge 14 as the arm 3. It would be possible to construct a training device 1 according to the present embodiment alternatively by continuing the extension 13 of the arm 3 through the hinge 14 and attaching the platform 5 on the opposite side of the hinge 14.

Figure 3B:
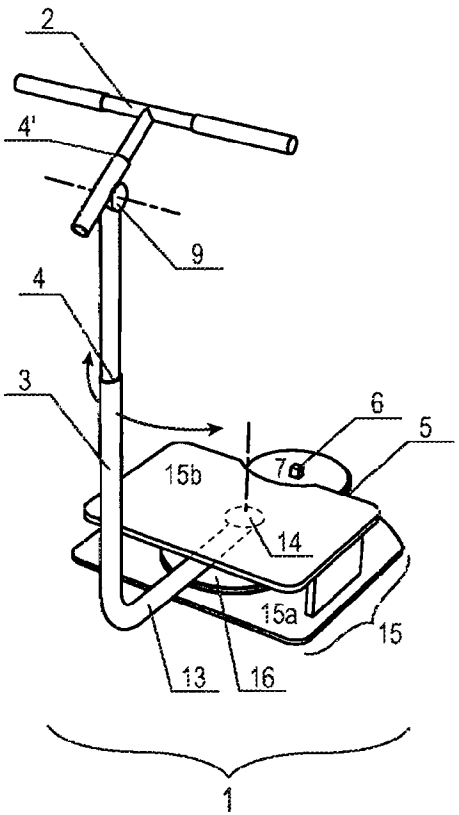
FIGS. 3B and 3C present variations of the embodiment of FIG. 3A.

FIG. 3B presents the embodiment of FIG. 3A in which the movement of the extension 13 of the arm 3 rotates a gearwheel 16. The gearwheel 16 is in communication with a platform 5 configured to be a flywheel through a cogged belt 17 (not visible in the figure). The platform 5 is configured to be a flywheel creating inertia resisting the change of the exercise movement direction. The weights 7 are attached to the flywheel 5 by the weight attachment means 6. The heaviness of the exercise movement can be adjusted through weights 7 of different mass, or through gearing in the flywheel 5 that allows changing the transmission between the gearwheel 16 and the flywheel 5.

Figure 3C:
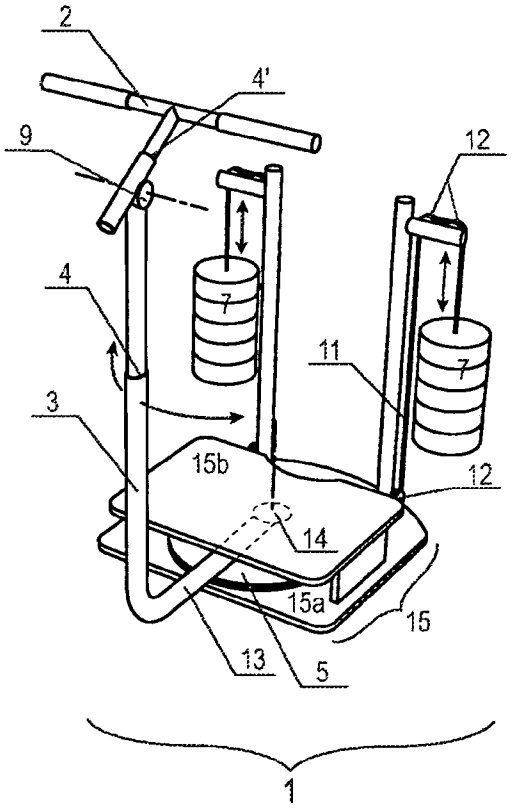

FIG. 3C presents the embodiment of FIG. 3A in which the movement of the extension 13 of the arm 3 moves a pair of weights 7 through a wire, rope or a belt 11. In FIG. 3C, the movement of the handle 2 is mediated to the weights 7 by a platform 5 configured to be a pulley 5, but it would be possible to attach the wire, rope or the belt 11 directly to the arm 3 or its extension 13. In FIG. 3C, the wire, rope or the belt 11 runs through rollers 12 that convert the rotating movement of the pulley 5 into the linear movement of the weights 7. Although in FIG. 3C, the movement of the weights 7 is vertical, also horizontal movement along rails, tracks or similar would be possible. The weight attachment means 6 (not indicated in the figure) can have any construction known in the field for attaching and adjusting linearly moveable weight stacks in training devices.

Figure 4A:
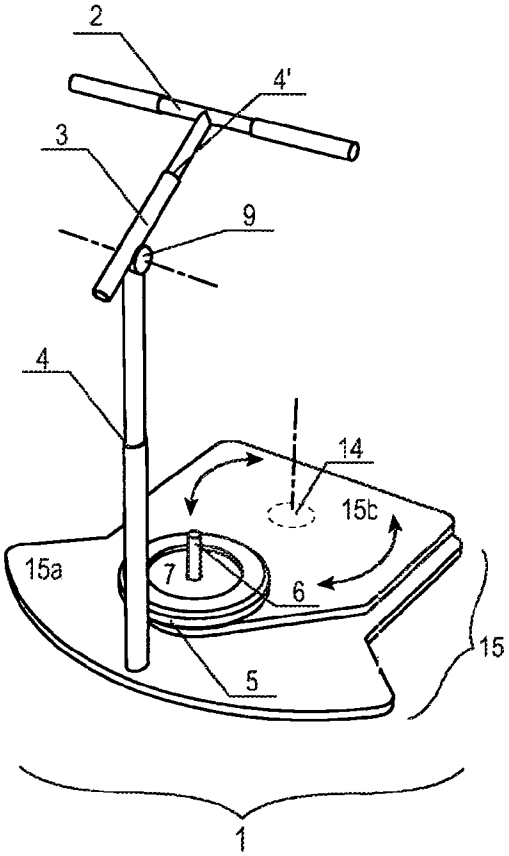
FIG. 4A presents a schematic overview of an embodiment in which there is a stationary stand and a rotatable training pedestal connected to the stand for rotation in relation to the stand.

FIG. 4A presents an embodiment of the training device 1 in which the arm 3, as in FIGS. 2 and 3, is divided into two parts through the joint 9. The arm 3 is fixed on the support plate 15*a* of the stand 15. In addition to the support plate 15*a*, the stand 15 comprises the training pedestal 15*b*, which in this embodiment, is rotatably hinged to the support plate 15*a* by the hinge 14 (movement depicted by double-headed arrows). The hinge 14 is located so, that it can be aligned with the vertical centerline of the user (vertical dashed line) when the user is on the training pedestal 15*b* holding the handle 2 in an appropriate training position.

The platform 5, weight attachment means 6 and the weights 7 move with the training pedestal 15*b* and, together with the weight of the user, provide the mass to be moved in the exercise. The heaviness of the exercise movement can be adjusted through weights 7 of different mass, through changing the distance of the weights 7 from the hinge 14, or the combination of both alternatives.

Figure 4B:
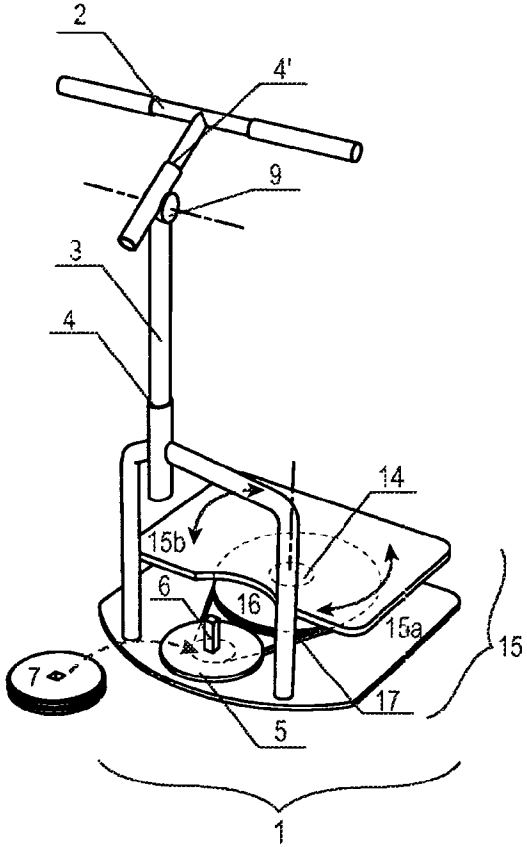
FIGS. 4B and 4C present variations of the embodiment of FIG. 4A.

FIG. 4B presents the embodiment of FIG. 4A in which the movement of the training pedestal 15*b* rotates the gearwheel 16 through the hinge 14. The gearwheel 16 is in communication with the platform 5 configured to be a flywheel through a cogged belt 17. The flywheel 5 can be either geared, loadable with different weights 7 or both in order to adjust the heaviness of the exercise movement.

Figure 4C:
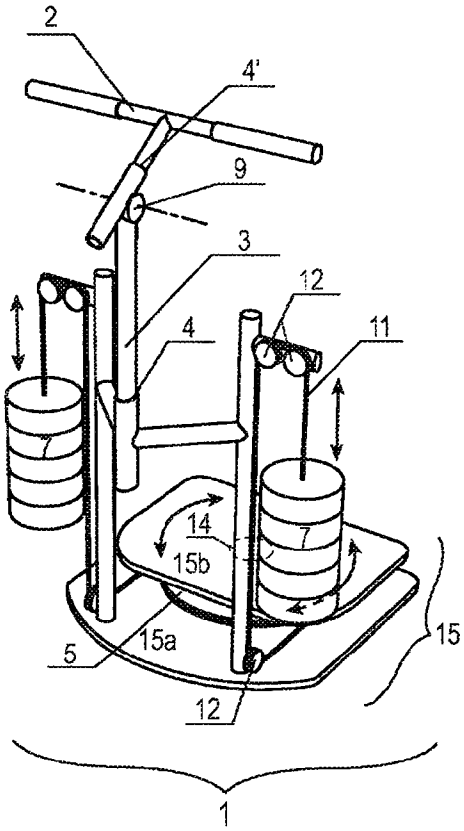

FIG. 4C presents the embodiment of FIG. 4A in which the movement of the training pedestal rotates a wheel-shaped platform 5 (the arched double-headed arrows). The platform 5 is connected to a pair of weights 7 as in FIG. 3C.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A training device for training abdominal muscles of a user, the training device comprising a single arm, a handle for holding with two hands, the handle being attached to or forming an integral part of the single arm, wherein the training device is configured to be moveable to any direction on a surface and comprises a platform attached to or forming an integral part of the single arm and having a weight attachment means provided thereon and configured to carry a mass, and wheels, gliders, or rollers attached to the platform for enabling movement of the training device on the surface by the user, wherein the wheels, gliders, or rollers are configured to allow movement of the training device into any direction on the surface directly from a stationary position, wherein the mass is either an integral part of the platform or can be adjusted through detachable weights.

2. The training device according to claim 1, wherein the training device is configured to be used on a flat surface.

3. The training device according to claim 2, wherein the wheels, gliders, or rollers comprise three wheels supporting the platform.

4. The training device according to claim 1, wherein the single arm is telescopic allowing height adjustment.

5. The training device according to claim 4, wherein the single arm has a joint for additional adjustment of the single arm and the handle.

6. The training device according to claim 1, wherein the wheels, gliders, or roller comprise three wheels supporting the platform.

7. The training device according to claim 1 wherein the single arm has a joint for additional adjustment of the single arm and the handle.

8. The training device according to claim 1, wherein the mass is an integral part of the platform.

9. The training device according to claim 1, wherein the mass is can be adjusted through detachable weights.

10. The training device according to claim 1, wherein the wheels, gliders, or rollers comprise three swivel wheels.

11. The training device according to claim 1, wherein the single arm is attached to the platform along a centerline of the platform, the single arm being aligned with the centerline of the platform.

12. The training device according to claim 1, wherein the single arm has a length between 95 cm to 140 cm.

13. A training device for training abdominal muscles of a user, the training device comprising a single arm, a handle for holding with two hands, the handle being attached to or forming an integral part of the single arm, wherein the training device is configured to be moveable to any direction on a surface and comprises a platform attached to or forming an integral part of the single arm and having a weight attachment means provided thereon and configured to carry a mass, and wheels, gliders, or rollers attached to the platform for enabling movement of the training device on the surface by the user, wherein the wheels, gliders, or rollers are configured to allow movement of the training device into any direction on the surface directly from a stationary position, wherein the single arm is a straight piece and at an angle so that a height of the training device and a radius of the weight movement are adjusted simultaneously.

14. The training device according to claim 13 wherein the single arm has a joint for additional adjustment of the single arm and the handle.

15. The training device according to claim 13, wherein the single arm is telescopic allowing height adjustment.

16. The training device according to claim 13, wherein the single arm has a length between 95 cm to 140 cm.

17. The training device according to claim 13, wherein the angle of the single arm relative to the platform is variable between 45 degrees and 75 degrees.

18. A training device for training abdominal muscles of a user, the training device comprising an arm, a handle for holding with two hands, the handle being attached to or forming an integral part of the arm, wherein the training device is configured to be moveable to any direction on a surface and comprises a platform attached to or forming an integral part of the arm and having a weight attachment means provided thereon and configured to carry a mass, and wheels or gliders or rollers attached to the platform and positioned underneath the platform for enabling movement of the training device on the surface by the user, wherein the wheels, gliders, or rollers are configured to allow movement of the training device into any direction on the surface directly from a stationary position, wherein the mass is either an integral part of the platform or can be adjusted through detachable weights.

19. The training device according to claim 18, wherein the training device is configured to be used on a flat surface.

20. The training device according to claim 18, wherein the arm is telescopic allowing height adjustment.

21. The training device according to claim 18, wherein the arm has a joint for additional adjustment of the arm and the handle.

22. The training device according to claim 18, wherein the wheels, gliders, or rollers comprise three swivel wheels.

23. The training device according to claim 18, wherein the arm has a length between 95 cm to 140 cm.

24. A training device for training abdominal muscles of a user, the training device comprising an arm, a handle for holding with two hands, the handle being attached to or forming an integral part of the arm, wherein the training device is configured to be moveable to any direction on a surface and comprises a platform attached to or forming an integral part of the arm and having a weight attachment means provided thereon and configured to carry a mass, and wheels or gliders or rollers attached to the platform and positioned underneath the platform for enabling movement of the training device on the surface by the user, wherein the wheels, gliders, or rollers are configured to allow movement of the training device into any direction on the surface directly from a stationary position, wherein the arm is a straight piece and at an angle so that a height of the training device and a radius of the weight movement are adjusted simultaneously.

25. The training device according to claim 24, wherein the arm has a length between 95 cm to 140 cm.

26. The training device according to claim 24, wherein the angle of the arm relative to the platform is variable between 45 degrees and 75 degrees.

* * * * *